United States Patent [19]

Wiegand et al.

[11] Patent Number: 4,778,075

[45] Date of Patent: Oct. 18, 1988

[54] RIB FORM FOR TANK RIBS

[75] Inventors: Joseph R. Wiegand; A. Michael Weaver, both of Bakersfield, Calif.

[73] Assignee: Owens-Corning Fiberglas Corporation, Toledo, Ohio

[21] Appl. No.: 871,225

[22] Filed: Jun. 6, 1986

[51] Int. Cl.[4] ..... B65D 7/46

[52] U.S. Cl. ..... 220/71; 229/DIG. 1; 220/83

[58] Field of Search ..... 220/71, 72, 83, 5 A; 229/DIG. 1, 1.5 R, 22

[56] References Cited

U.S. PATENT DOCUMENTS 3,394,841 7/1968 Anderson ..... 220/71

3,529,987 9/1970 Lemelson ..... 220/72 X 3,661,294 5/1972 Pearson et al. ..... 220/72 X 3,708,101 1/1973 McDanield ..... 229/DIG. 1 X

*Primary Examiner*—Steven M. Pollard

*Attorney, Agent, or Firm*—Patrick P. Pacella; Charles R. Schaub

[57] ABSTRACT

The rib form comprises a cardboard blank folded into a trapezoidal shape and having overlapping opposite longitudinal edge portions of the blank glued together and forming the shorter of the two parallel sides of the trapezoidal shape. Peripheral slots evenly spaced along the rib form are cut through the longer of the parallel sides and through the two angular sides of the trapezoidal shape.

2 Claims, 2 Drawing Sheets

RIB FORM FOR TANK RIBS

TECHNICAL FIELD

This invention relates generally to reinforced plastic cylindrical storage tanks particularly adapted for use underground, and more particularly to a rib form for forming reinforcing ribs on such tanks.

BACKGROUND ART

Reinforced plastic cylindrical storage tanks are generally initially made with relatively thin, flexible walls to reduce the amount of resin required, and subsequently provided with external annular reinforcing ribs to increase rigidity. The ribs are formed of reinforced resin over cardboard rib forms. Prior to our invention, rib forms such as shown in U.S. Pat. No. 3,700,512, issued to Lee E. Pearson and Jeri O. Clark on Oct. 24, 1972, were most generally used. The prior rib form was three-sided in cross section, i.e., trapezoidal with the longer of the two parallel sides omitted, and was stapled to trapezoidal wood or plastic blocks at intervals for the retaining of its shape.

DISCLOSURE OF INVENTION

In accordance with the invention, a flat rib form blank is scored longitudinally along four lines to provide five sections for folding of the blank into a trapezoidal shape with the two end sections glued together along the shorter of the two parallel sides of the trapezoid. The three middle sections of the blank are provided with transversely extending cutouts at intervals to allow bending of the completed rib form around a cylindrical tank during the manufacturing process.

BRIEF DESCRIPTION OF THE DRAWINGS

The invention is hereinafter more fully explained, reference being had to the accompanying drawings wherein.

BEST MODE OF CARRYING OUT THE INVENTION

Figure 1:
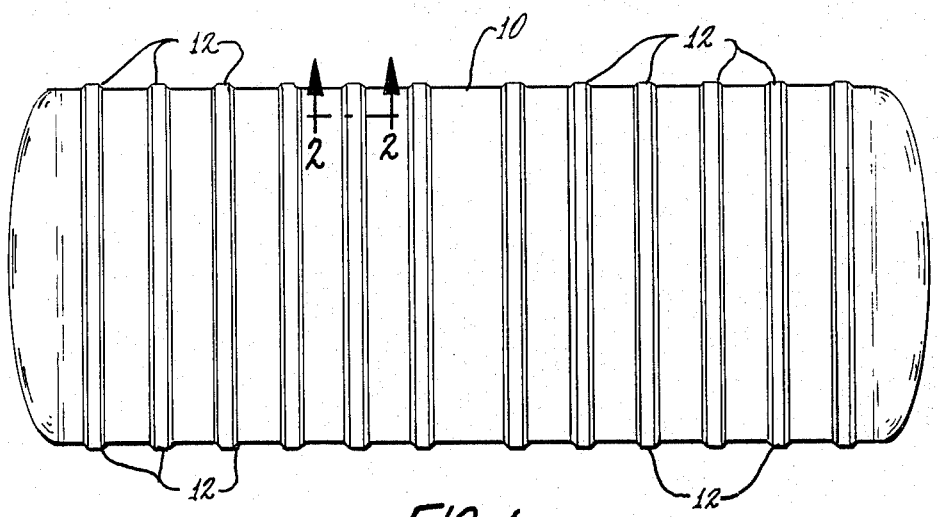
FIG. 1 is a side elevational view of a tank having annular ribs formed over rib forms constructed in accordance with the invention.
Figure 2:
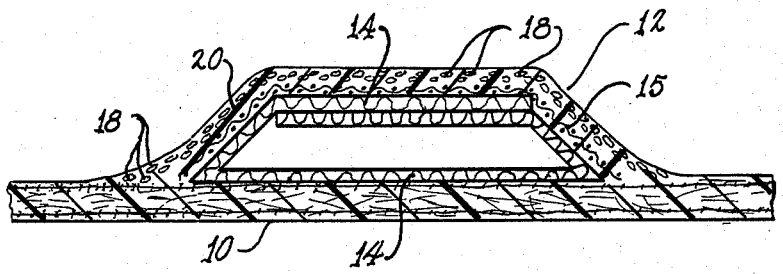
FIG. 2 is an enlarged sectional view taken generally along the line 2—2 of FIG. 1.

With reference to the drawings, FIG. 1 shows a tank 10 of glass fiber reinforced plastic. The tank 10 is provided with a plurality of axially spaced annular ribs 12 also of glass fiber reinforced plastic. The ribs 12 are formed respectively over rib forms 14 (FIGS. 2, 3, and 5) constructed in accordance with the invention, and may comprise woven roving, continuous strand mat, chopped strand mat, axial tape, chopped strands, or continuous filament windings, or various combinations thereof, in a thermosetting resin. FIG. 2 shows a rib 12 including a woven glass roving mat 15 and continuous glass filament windings 18 in thermoset resin 20, formed over a rib form 14 applied to the sidewall of the tank 10.

Figure 3:
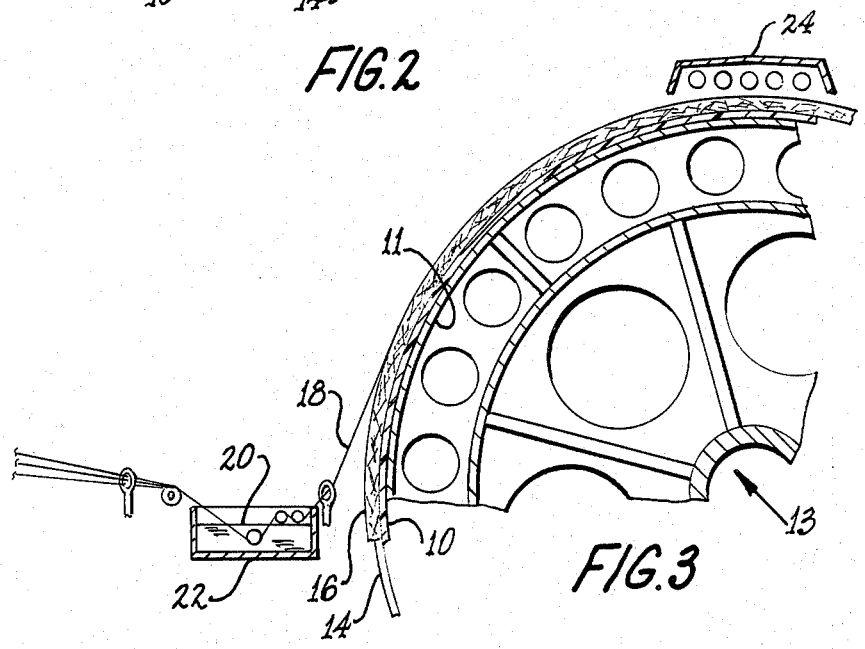
FIG. 3 is a fragmentary cross-sectional view of a tank-forming mandrel showing a rib form constructed in accordance with the invention being applied to a generally cylindrical wall portion of a tank.

FIG. 3 shows a rib form 14 and a chopped strand mat 16 being applied to a generally cylindrical sidewall of a tank 10 formed on an outer mold surface of a shell 11 of a rotating mandrel 13. The rib form 14 and mat 16 are held in place by continuous glass filament windings 18 impregnated with thermosetting resin 20 in a tank 22. The resin of the tank 10 and ribs 12 is cured under a heater 24 above the mandrel 13.

Figure 4:
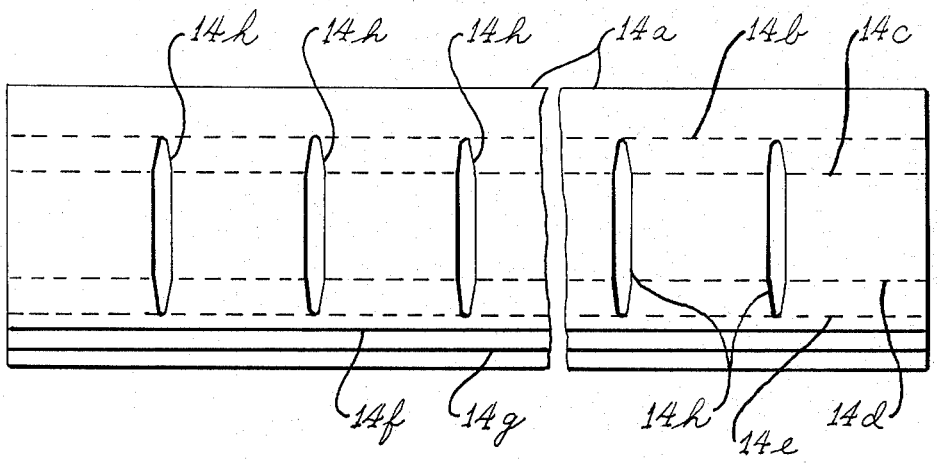
FIG. 4 is a fragmentary plan view of a rib form blank of the invention before it is folded into a rib form.
Figure 5:
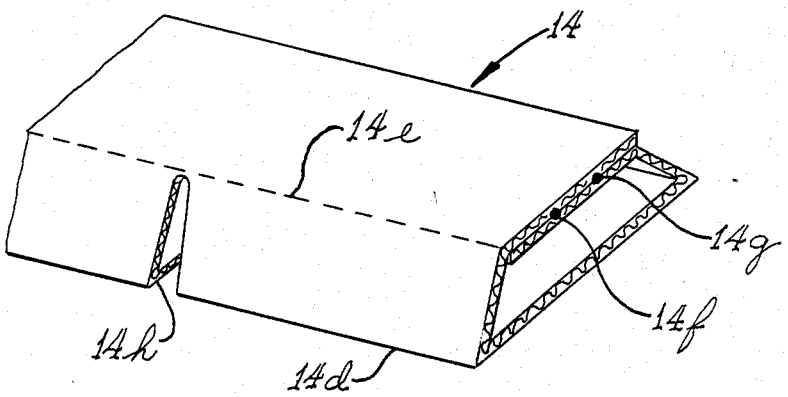
FIG. 5 is a fragmentary isometric view of a rib form constructed in accordance with the invention.

FIG. 4 shows a blank **14*a* for a rib form 14. The blank 14*a* is made of corrugated cardboard faced on both sides and is scored or perforated along four lines 14*b*, 14*c*, 14*d*, and 14*e* and is provided on one end flap with two lines 14*f* and 14*g* of glue before being folded and glued as shown in FIG. 5. In order to enable bending of the rib form around a tank, the blank 14*a* is provided with a plurality of transversely extending slots 14*h* at spaced intervals along its length. The slots 14*h* extend across three middle sections of the blank 14*a*** which become the longer of the parallel sides of a trapezoidal shape and the two non-parallel sides thereof.

The rib form 14 retains its cross-sectional shape under the load placed thereon by the winding filaments, and needs no wood or plastic blocks and staples as in the prior rib forms. Further, the rib forms 14 are stronger and more uniform in shape than the prior stapled rib form. They can be positioned more accurately and thereby improve tank quality. Their smooth sides allow the rib to be formed of chopped glass roving if desired.

Various modifications may be made in the structure shown and described without department from the scope of the invention.

We claim:

1. A rib form blank that can be positioned on a glass fiber reinforced plastic tank and over which a glass fiber reinforced plastic reinforcing rib can be formed to reinforce the walls of the tank, the rib form blank comprising a rectangular elongate sheet of cardboard provided with four parallel longitudinally extending fold lines to facilitate folding thereof into a trapezoidal cross-sectional shape with overlapping end sections forming a shorter of two parallel sides of the trapezoidal shape, the overlapping end sections being secured together the cardboard sheet also being provided with a plurality of longitudinally evenly spaced transversely extending slots extending between two outer ones of the fold lines substantially all the way from one to the other to facilitate bending of a rib form formed from the blank into an arcuate shape, said slots extending across the three sections of the blank which form the longer of the parallel sides of the trapazoidal shape and the two non-parallel sides and extending to the end sections which overlap to form the shorter of the parallel sides of the trapazoidal shape.

2. A hollow elongate cardboard rib form that can be positioned on a glass fiber reinforced plastic tank and over which a glass fiber reinforced plastic reinforcing rib can be formed to reinforce the walls of the tank, the rib form having a trapezoidal cross-sectional shape, having a double thickness of cardboard at a shorter of two parallel sides of the trapezoidal shape, said double thickness comprising overlapped and glued together opposite longitudinal edge portions of a starting flat blank from which the rib form is made, and having a plurality of longitudinally evenly spaced peripherally extending slots each cut through a longer of the two parallel sides and through two angular sides of the trapezoidal shape and ending substantially at the shorter double-thickness side of the trapezoidal shape.

* * * * *